US007510302B1

(12) United States Patent
Curtis et al.

(10) Patent No.: US 7,510,302 B1
(45) Date of Patent: Mar. 31, 2009

(54) LIGHT FIXTURE WITH PIVOTABLE LAMP MOUNT

(75) Inventors: Craig T. Curtis, Hartford, WI (US); Robert T. Allen, Green Bay, WI (US); Curt H. Blaszczyk, Fredonia, WI (US)

(73) Assignee: SPI Lighting, Inc., Mequon, WI (US)

( * ) Notice: Subject to any disclaimer, the term of this patent is extended or adjusted under 35 U.S.C. 154(b) by 0 days.

(21) Appl. No.: 11/735,195

(22) Filed: Apr. 13, 2007

(51) Int. Cl.
*F21V 21/00* (2006.01)

(52) U.S. Cl. ..... 362/287; 362/274; 362/288; 362/427

(58) Field of Classification Search ..... 362/219, 362/220, 225, 240, 269, 285, 287, 288, 370, 362/372, 418, 427, 429
See application file for complete search history.

(56) References Cited

U.S. PATENT DOCUMENTS

| | | | | | |
|---|---|---|---|---|---|
| 1,757,346 | A * | 5/1930 | Taussig | ..... | 362/285 |
| 1,805,193 | A * | 5/1931 | Smith | ..... | 362/287 |
| 1,902,026 | A * | 3/1933 | Hall | ..... | 362/220 |
| 3,909,100 | A * | 9/1975 | Hodge, Jr. | ..... | 362/220 |
| 4,498,126 | A * | 2/1985 | Hernandez | ..... | 362/288 |
| 5,023,765 | A * | 6/1991 | Barton | ..... | 362/429 |
| 6,565,234 | B1 * | 5/2003 | Skegin et al. | ..... | 362/427 |

* cited by examiner

*Primary Examiner*—Y My Quach Lee
(74) *Attorney, Agent, or Firm*—Boyle Fredrickson, S.C.

(57) ABSTRACT

A light assembly including a socket, a housing, and a mounting member. The socket is connected to the mounting member, which is pivotably secured to the housing and constructed to allow rotation of the socket, and thereby a lighting element engaged with the housing, relative to the housing.

9 Claims, 8 Drawing Sheets

LIGHT FIXTURE WITH PIVOTABLE LAMP MOUNT

FIELD OF THE INVENTION

The present invention relates to light fixtures and, more particularly, relates to a light assembly having a pivotable mounting arrangement for the lighting element of a light fixture.

BACKGROUND OF THE INVENTION

A light fixture typically includes one or more sockets, each of which is supported by the body or housing of the light fixture and electrically connected to a power supply. A lighting element, commonly known as a lamp or light bulb, is engaged with the socket such that when the light fixture is switched ON, power is communicated through the socket to illuminate the lighting element. In many light fixture configurations, the lighting element is positioned within or surrounded by a housing, shade, or reflector, which are configured to direct the light from the lighting element in accordance with the application and/or intended utilization of the light source. For example, a reflector may be positioned about the lighting element in an application in which light emitted from the lighting element is intended to be directed in a common direction. In another example, a housing may be positioned about the lighting element in an application such as a sconce or the like, in which it is desired to obscure the lighting element from certain directions within the room in which the fixture is mounted, and to direct light from the lighting element in an upward direction.

In designing a light fixture, the areas of the fixture adjacent the lighting element must be configured so as to enable replacement of the lighting element. This design criterion creates a certain amount of dead space about the lighting element, since the lighting element is initially engaged with the socket and is then moved inwardly into the socket such that a portion of the area originally occupied by the lighting element is empty when the lighting element is fully engaged with the socket. This necessarily reduces the efficiency of the light fixture, i.e. the number of lumens that can be produced from a fixture of a given size. While the light fixture can be designed to minimize the amount of this dead space, the surfaces of the light fixture adjacent the lighting element simply must be positioned so as not to unduly interfere with the replacement of the lighting element. This problem is compounded in light fixtures that include multiple lighting elements, since the fixture must be designed with a sufficient amount of dead space about each lighting element to enable the lighting elements to be removed and replaced.

It would therefore be desirable to have a light fixture assembly and method of connecting a lighting element to a light fixture that provides enhanced access to the lighting element without interfering with adjacent lighting elements and/or the surfaces of the housing about the lighting element.

BRIEF DESCRIPTION OF THE INVENTION

The present invention provides a system and method of mounting a lighting element to a light fixture housing that overcomes the aforementioned drawbacks. The invention contemplates a light fixture that includes a housing that is constructed with one or more surfaces that are located adjacent the lighting element, and which define an open area through which light from the lighting element is directed. The light fixture includes a socket constructed to engage the lighting element. The socket is pivotably interconnected with the housing for movement between a first, operating position and a second, replacement position. When the socket is in the first, operating position, a lighting element engaged with the socket is positioned closely adjacent the surfaces of the housing. When the socket is in the second, replacement position, the lighting element is positioned so as to be moved outwardly relative to the housing surfaces, and is oriented so as to facilitate removal of the lighting element from the socket and engagement of a replacement lighting element with the socket. The socket may be biased relative to the housing toward the first, operating position. When the lighting element requires replacement, the user manually engages the socket so as to pivot the socket away from the adjacent housing surfaces to provide access to the lighting element. The socket is constructed and attached to the housing such that the socket, and the attached lighting element, do not interfere with other lighting elements and/or sockets connected to the housing. Such a construction provides a light fixture assembly that is efficient, highly versatile and easy to maintain.

Other features and advantages of the present invention will become apparent to those skilled in the art from the detailed description and the accompanying drawings. It should be understood, however, that the detailed description and accompanying drawing figures, while indicating at least one preferred embodiment of the invention, are given by way of illustration and not of limitation. Many changes and modifications may be made within the scope of the invention without departing from the spirit thereof, and the invention is intended to include all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION

Figure 1:
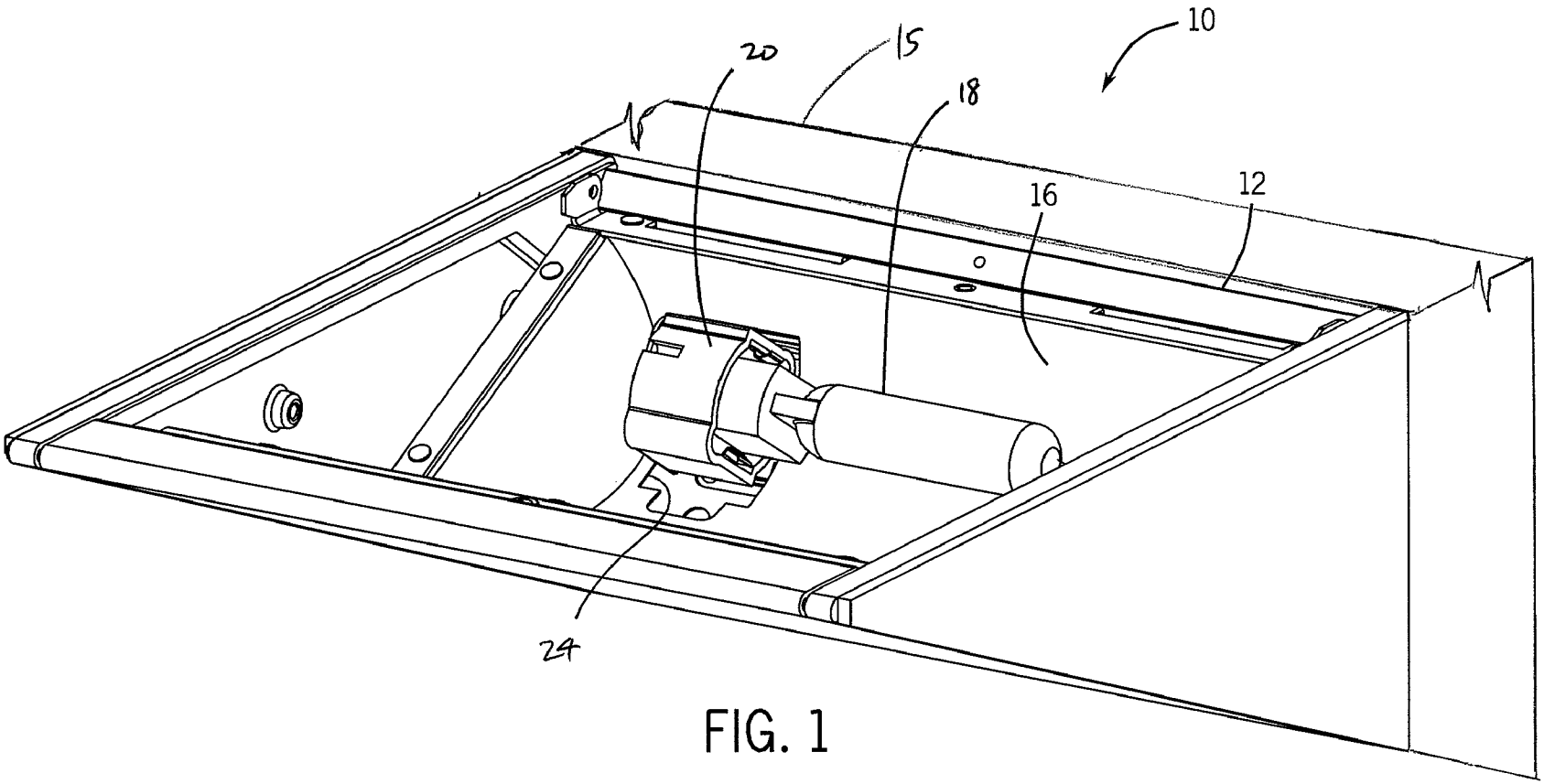
FIG. 1 is a perspective view of one embodiment of a light fixture according to the present invention showing a lighting element, in the form of a light bulb, engaged with the socket of the light fixture and in a first, operating position.

FIG. 1 illustrates a light fixture assembly 10 according to the present invention. Light fixture assembly 10 includes a reflector frame or housing 12, which defines an interior or internal cavity within which a reflector 16 is positioned. Reflector 16 is secured to housing 12 by a series of rivets 14 or other satisfactory connection means, and is constructed to direct the emission of light from the interior of housing 12 through an outwardly facing opening defined by housing 12. Typically, light fixture assembly 10 includes a ballast that may be incorporated in a base arrangement 15 to which housing 12 is connected, and which is configured for mounting to a support surface such as a wall, in a manner as is known.

A lighting element or illumination device, shown in the form of a light bulb 18, is disposed generally within the interior of fixture 10 and is electrically connected to a socket 20. The lighting element may be any satisfactory type, including an incandescent or halogen bulb, compact fluorescent, LED cluster, etc. Socket 20 is secured to reflector 16, and reflector 16 includes an opening 24 through which socket 20 protrudes or extends. In this manner, socket 20 is located such that light bulb 18 is positioned outwardly of the reflective surfaces of reflector 16, and is accessible within the interior of light fixture 10 through the opening defined by housing 12 to enable replacement of light bulb 18, in a manner to be explained, without the need to disassemble fixture 10. In FIG. 1, light bulb 18 is illustrated in a normal operating position, in which light bulb 18 is oriented generally parallel to the surfaces of reflector 16 and in relatively close proximity thereto. In the illustrated embodiment, light bulb 18 is slidably engageable with socket 20 such that engagement of bulb 18 with socket 20 electrically connects the bulb to a power source. It is understood, however, that light bulb 18 and socket 20 may have any other satisfactory type of engagement arrangement, such as a thread connection, a twist-type connection, etc.

Figure 2:
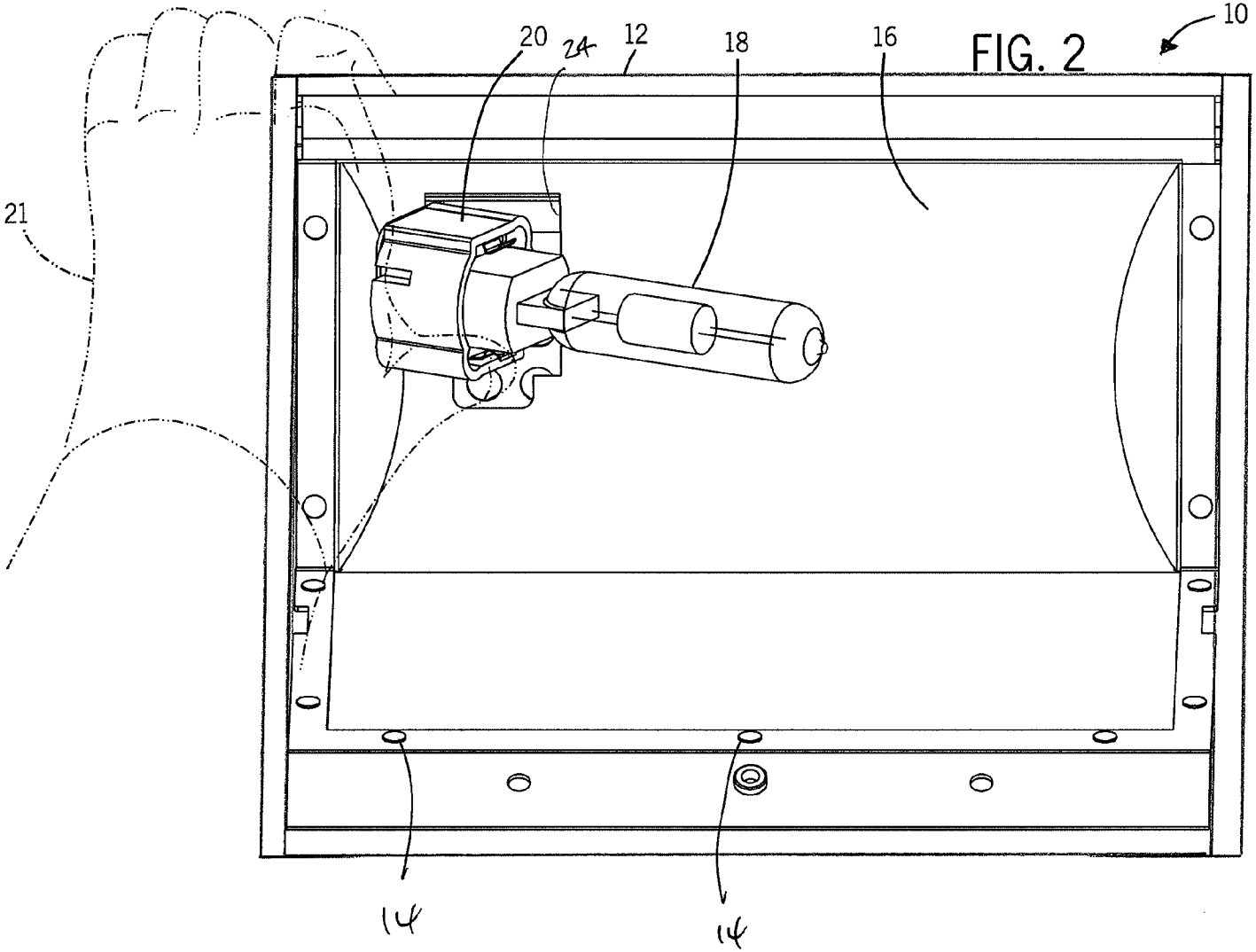
FIG. 2 is a perspective view of the light fixture shown in FIG. 1, showing the light bulb and socket pivoted to a second, replacement position.

As shown in FIG. 2, socket 20 is pivotably connected to reflector 16 such that the bulb and socket assembly can be pivoted outwardly relative to reflector 16. That is, as described further below with respect to FIGS. 7-12, the application of pressure to socket 20, which may be applied by the user's hand as shown at 21, pivotably or rotationally displaces socket 20 and light bulb 18 relative to reflector 16 to an angularly displaced replacement or service position, which provides user access to the light bulb 18. Accordingly, the present invention facilitates the expeditious and convenient replacement of light bulb 18 by selectively providing easy access to the light bulb 18.

Figure 3:
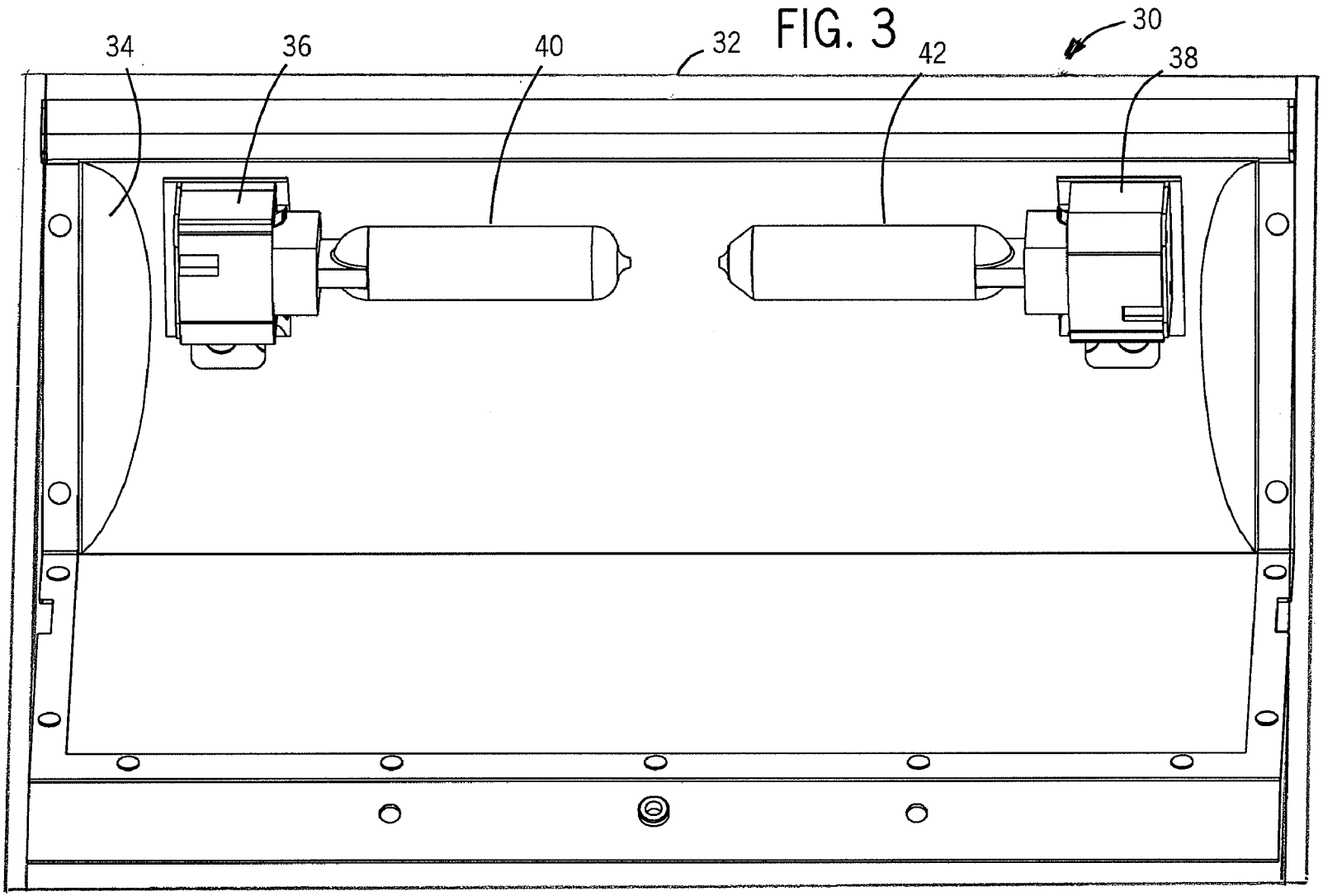
FIG. 3 is a perspective view of another embodiment of a light fixture according to the present invention which has two light elements, each of which is shown in a first, operating position.
Figure 4:
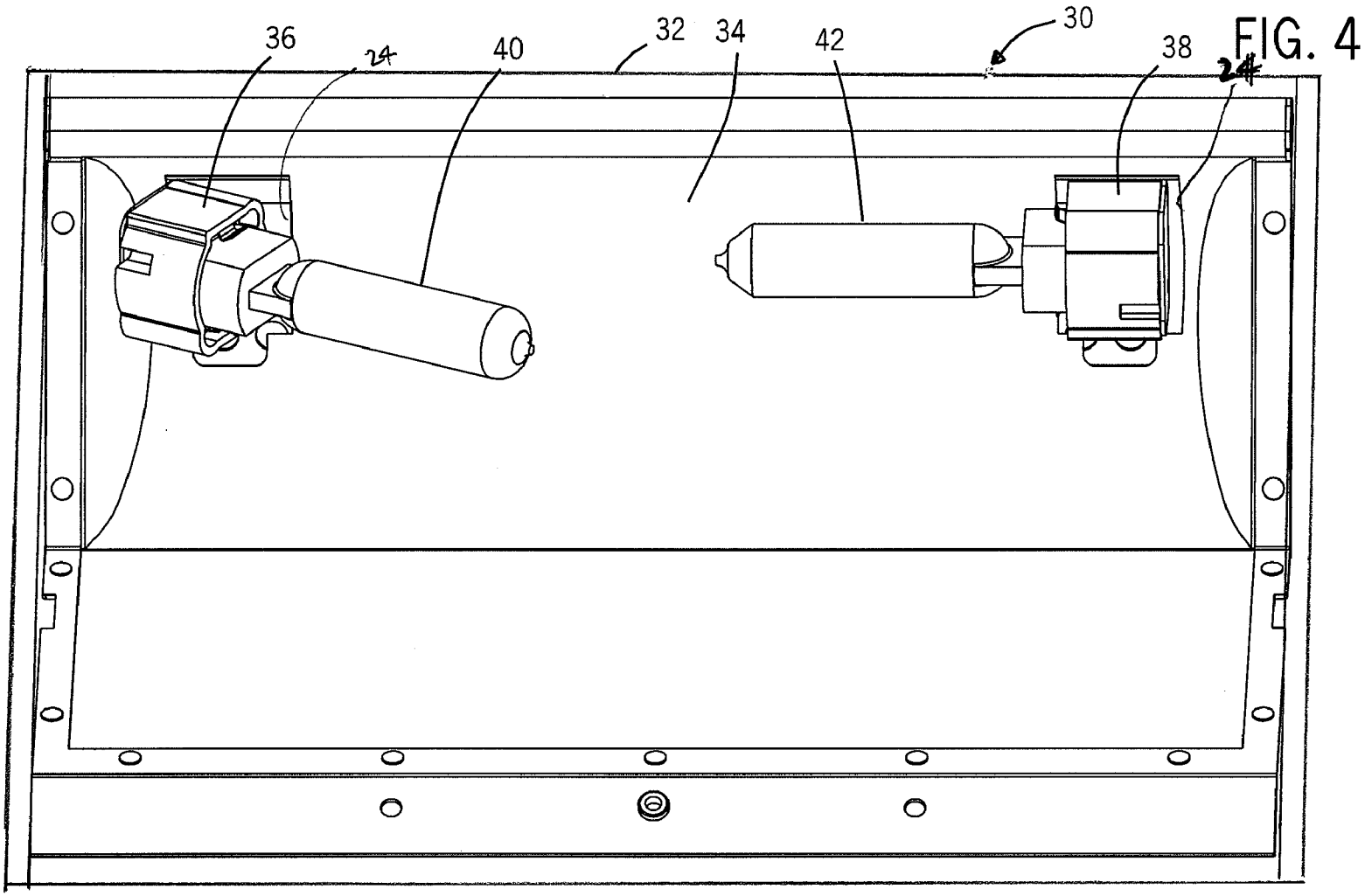
FIG. 4 is a perspective view of the light fixture shown in FIG. 3 showing one of the light bulbs and sockets pivoted to a second, replacement position.
Figure 5:
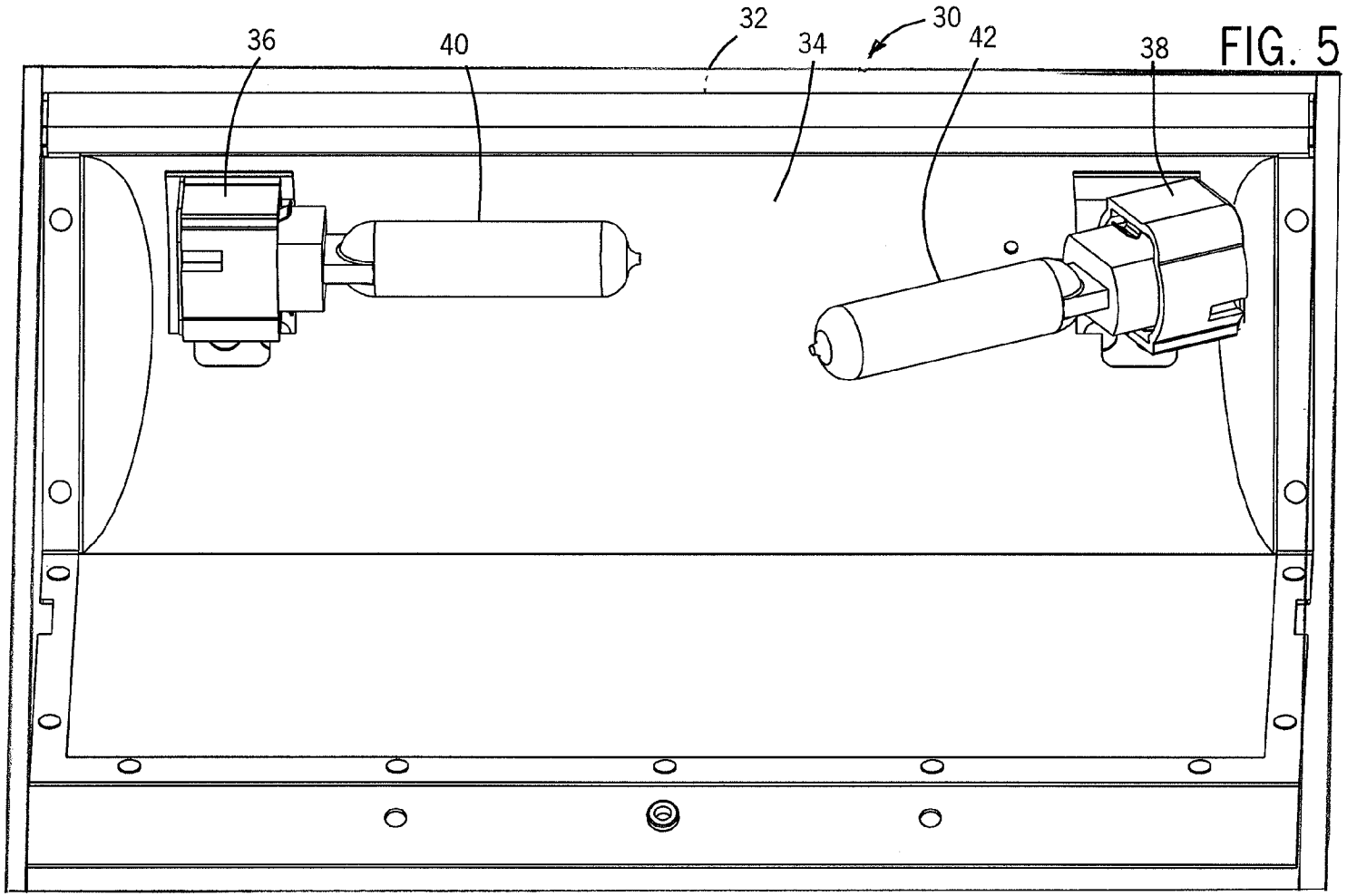
FIG. 5 is a perspective view of the light fixture shown in FIG. 3 showing the other light bulb and socket pivoted to a second, replacement position.
Figure 6:
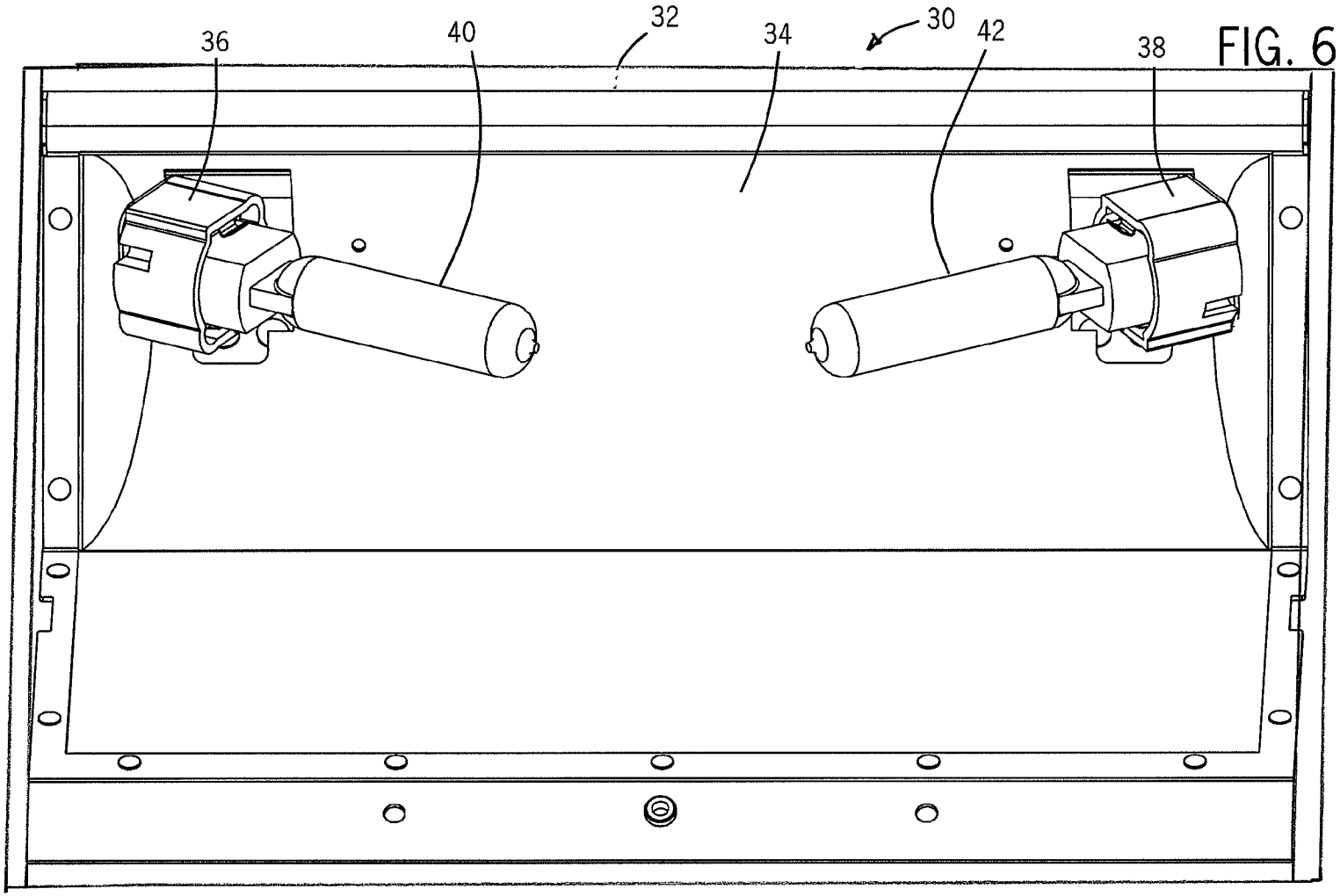
FIG. 6 is a perspective view of the light fixture shown in FIG. 3 showing both of the light bulbs and sockets pivoted to the second, replacement position.

FIG. 3 shows another embodiment of a light fixture according to the present invention, shown at 30. As shown in FIG. 3, light fixture assembly 30 includes a housing 32 defining an interior within which a reflector 34 is located. A first socket 36 and a second socket 38 extend through openings 24 in reflector 34, and are positioned within the interior of housing 32. Respective first and second light bulbs 40, 42 are engaged with sockets 36, 38. As shown in FIGS. 4, 5, and 6, first bulb 36 and its associated socket 40, and second bulb 38 and its associated socket 42, are individually and independently pivotably connected to reflector 16. That is, each bulb and its associated socket is pivotable or rotatable between a normal operating position, as shown in FIG. 3, and a second, service re replacement position as shown in FIGS. 4-6, either individually, as shown in FIGS. 4 and 5, or at the same time, as shown in FIG. 6. Such a construction enhances the versatility of light fixture assembly 30 as well as the ease of removing and replacing any of bulbs 18, 40, and 42. When the bulbs 40, 42 and respective sockets 36, 38 are in the normal operating positions, the longitudinal axes of the bulbs are in alignment with each other. This feature enables the bulbs 40, 42 to be close together and in the same position above the surface of the reflector 16, so as to minimize the space occupied by the bulbs and to provide a high degree of light output from a relatively small package.

In both versions of the light fixture as shown in FIGS. 1-6, the sockets may be positioned such that the light bulbs can be located in closer proximity to the component or surface adjacent the outer end of the light bulb than would otherwise be possible in a fixed socket fixture. That is, in the single bulb version of FIGS. 1 and 2, the socket 20 may be positioned such that the end of the bulb 18 may be in relatively close proximity to the facing surface of reflector 16 and/or housing 12 when bulb 18 is in the normal operating position of FIG. 1. When socket 20 is pivoted to the service or replacement position of FIG. 2, the light bulb 18 is positioned such that the end of bulb 18 is clear of the adjacent surfaces of reflector 16 or housing 12 to facilitate removal or replacement. Similarly, in the dual bulb version of FIGS. 3-6, the sockets 36, 38 can be positioned such that the respective light bulbs 40, 42 are in alignment with each other and the facing ends of the bulbs 40, 42 are in close proximity to each other when the sockets 36, 38 are in the normal operating position as shown in FIG. 3. When the sockets 36, 38 are pivoted to the service or replacement position as shown in FIGS. 4-6, the ends of the bulbs 40, 42 are positioned out of alignment with each other. In this manner, the sockets 36, 38 can be positioned such that the bulbs 40, 42 are close together and in alignment with each other during normal operation, which would otherwise not be possible if the sockets 36, 38 were positioned to require distance and clearance for pull-out of the bulbs 40, 42, and can be quickly and easily released from engagement with the sockets 36, 38. In the dual light bulb version, while the drawings show both of the sockets 36, 38 as being pivotable to the service or replacement position, it is understood that the same advantage and result can be obtained by pivotably mounting only a single one of sockets 36, 38 to housing 12 while the other is fixed in position.

Figure 7:
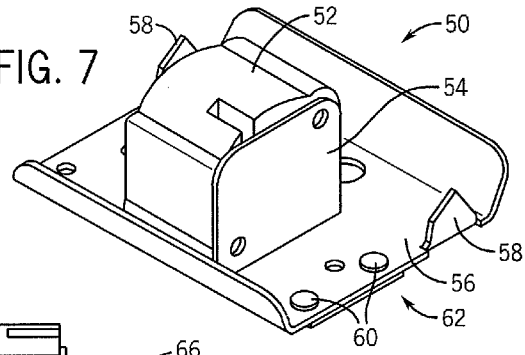
FIG. 7 is a perspective view of a socket mount assembly incorporated in the light fixtures shown in FIGS. 1-6, and illustrating the socket is in the first, operating position.
Figure 8:
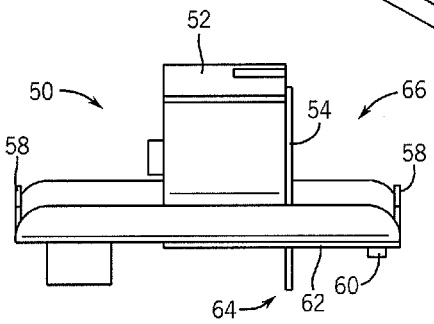
FIG. 8 is an elevational view of the socket and socket mount assembly shown in FIG. 7.

FIG. 7 shows a perspective view of a socket assembly 50 that is used to mount the sockets such as 20, 36 and 38 to the reflectors of fixture assemblies 10, 30. Socket assembly 50 includes a socket 52, which is the same as sockets 20, 36 and 38 as shown and discussed previously, and which is configured to engage and retain the lighting element, such as light bulb 18. Socket 52 is connected to a support 54, which in turn is connected to a mounting bracket 56. Mounting bracket 56 includes a pair of tabs 58 constructed to engage the reflector 16 of the light fixture 10 and secure the socket assembly 50 thereto. A pair of pins 60 secure a biasing member 62, which is illustrated as being in the form of a biasing plate, to mounting bracket 56. As shown in FIG. 8, an arm 64 extends from support 54 and passes through mounting bracket 56. Arm 64 extends outwardly from biasing plate 62 through an opening 65 (shown in FIG. 11) formed in biasing plate 62, and generally maintains the association of support 54 and biasing plate 62. The position of socket 52 relative to mounting bracket 56 generally defines an operating position of socket 52, as shown at 66 in FIG. 8.

Figure 9:
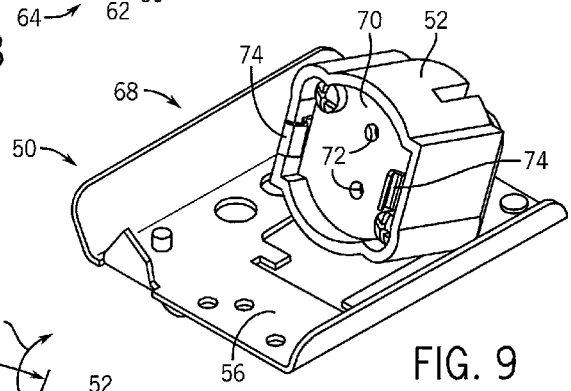
FIG. 9 is a perspective view of the socket and socket mount assembly of FIGS. 7 and 8, showing the socket pivoted to the second, replacement position as shown in FIGS. 2 and 4-6.
Figure 10:
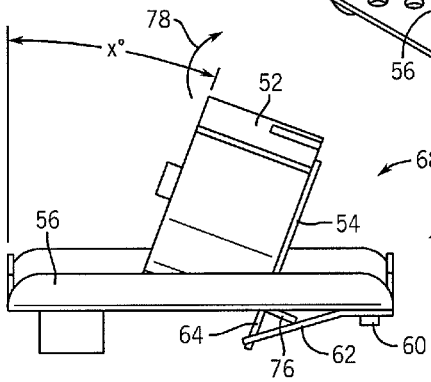
FIG. 10 is an elevational view of the socket and socket mount assembly shown in FIG. 9.

Referring to FIGS. 9 and 10, socket 52 is rotatably or pivotably connected to mounting plate 56 such that socket 52 is movable from the operating position 66 of FIG. 8 to a service or replacement position, shown at 68. As shown in FIG. 9, socket 52 includes a recess 70 having a number of recesses 72 therein, which form electrical connections for light bulb 18. A pair of tabs 74 are generally disposed on opposite sides of recess 70, and may function to engage and removably secure light bulb 18 with socket 52. It should be noted that the socket 52 may be constructed in a variety of forms to accommodate any bulb type, for example a screw mount incandescent or compact fluorescent bulb. As shown in FIG. 10, socket 52 can be pivoted relative to mounting bracket 56 as indicated by angle shown at X. Preferably, angle X may be 20 degrees from vertical, but other angles will substantially achieve the same purpose in facilitating removal and replacement of light bulb 18.

Support 54 includes a pair of tabs or positioning members 76 located one on either side of arm 64, which extend from support 54 generally transverse thereto. Positioning members 76 are constructed so as to ensure proper bulb and socket positioning relative to reflector 16 when socket 52 is in the operative position 66, and normally engage biasing member 62 in a coplanar relationship. When socket 52 is subjected to a rotational moment, indicated by arrow 78, positioning members 76 engage biasing plate 62 and deflect the biasing plate 62 outwardly away from mounting bracket 56, as shown in FIG. 10, which allows rotation of socket 52 and support 54 relative to mounting bracket 56 while providing a biasing force that tends to return socket 52 toward the operative position. Tab 64 of support moves within opening 65 of biasing plate 64 during such movement of socket 52, and engages the ends of opening 65 to define the range of pivoting movement of socket 52. After a user has completed the desired manipulation of the light bulb 18 connected to socket 52, i.e. has either changed or cleaned the light bulb 18, the user releases socket 52 and biasing member 62 functions to return positioning members 76 of support 54 to the original position in which positioning members 76 are coplanar with biasing member 62 and socket 52 is in the operating position. That is, biasing member 62 forces positioning members 76 out of the path of deflection of the biasing member 62 and thereby returns the socket 52 to the operating position. Such a construction provides a fixture assembly having sockets that can be quickly and efficiently deflected to improve access to the light bulb 18 connected thereto. The pivotable connection of support 54 to mounting bracket 56 also provides for a compact fixture assembly with enhanced illumination density. That is, for fixtures having multiple lighting elements, the lighting elements can be closely positioned to one another thereby reducing the overall size of the fixture as compared to a fixture without such a pivotable feature associated with the socket. In a fixture having a single lighting element, the lighting element can be positioned in close proximity to the adjacent surfaces of the fixture, which enables a more compact fixture design than would otherwise be possible.

Figure 11:
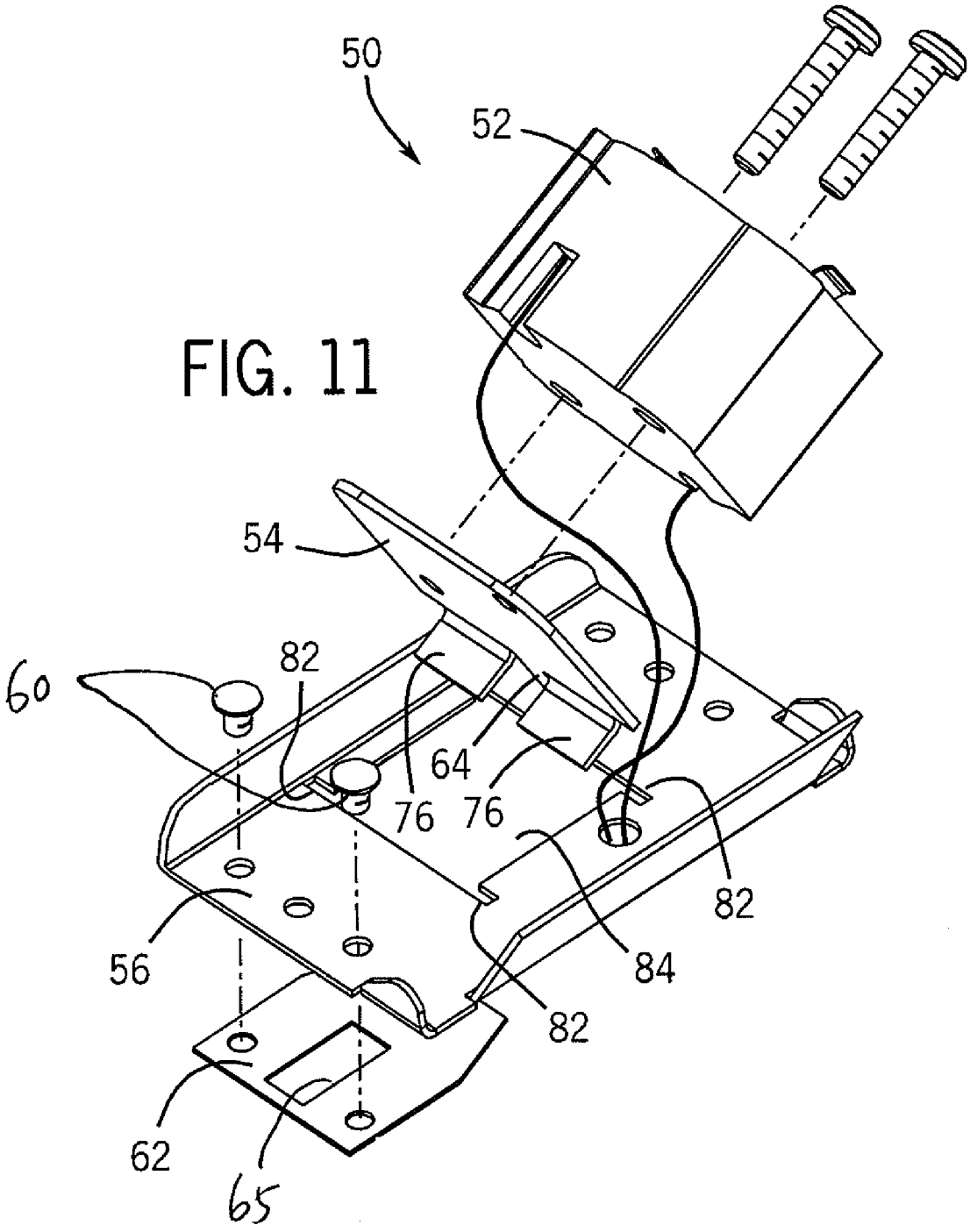
FIG. 11 is an exploded perspective view of the socket and socket mount assembly shown in FIGS. 7-10.

FIG. 11 shows an exploded view of the socket assembly 50. A fastener 80 secures socket 52 to support 54. Positioning members 76 pass through an opening 84 in mounting bracket 56, and the edges of support 54 are received within slots 82 formed in mounting bracket 56 and which extend outwardly of opening 84. Arm 64 of support 54 passes through opening 84 and through an underlying opening in biasing member 62. Such a construction pivotally connects support 54 to mounting bracket 56. Pins 60 secure biasing member 62 to mounting bracket 56. Biasing member 62 engages positioning members 76 of support 54 and, as noted above, biases support 54 to the operating position in which support 54 is preferably oriented generally transverse to mounting bracket 56. Understandably, it is envisioned and within the scope of the invention that the engagement between support 54, mounting bracket 56, and biasing member 62 may be configured to provide other orientations of socket assembly 50 relative to the lighting fixture within which the socket assembly 50 is positioned. That is, it is appreciated that the range of rotation of socket 52 relative to mounting plate 56 is configured for a selected application, and that range of movement of the socket 52 and light bulb 18 may be other than the range as shown and described.

It is also to be understood that, although the foregoing description and drawings describe and illustrate in detail one or more preferred embodiments of the invention, to those skilled in the art to which the invention relates, the aforementioned will suggest many modifications and constructions as well as widely differing embodiments and applications without thereby departing from the spirit and scope of the invention.

What is claimed is:

1. A light fixture assembly comprising:

a first socket and a second socket, wherein the first and second sockets are constructed to engage respective first and second lighting elements;

a first mounting member and a second mounting member, wherein each mounting member is constructed to be interconnected with a housing of the light fixture assembly; and a first support connected to the first socket and a second support connected to the second socket, wherein the first support is pivotably connected to the first mounting member and the second support is pivotably connected to the second mounting member, wherein the first and second supports and the first and second mounting members are configured to allow pivoting movement of the first and second sockets, respectively, between a first, operative position and a second, service position;

a biasing member for biasing each support to position the associated socket in the first operative position;

wherein the sockets, mounting members and supports are positioned such that the first and second lighting elements are aligned with each other when the first and second sockets are in the first operative positions, and wherein the biasing member is deflectable to allow pivoting movement of the socket from the first operative position to the second service position, and wherein the biasing member interacts with the support to limit the range of pivoting movement of the support.

2. The assembly of claim 1 wherein each support further comprises a tab constructed to pass through a slot formed in the associated mounting member.

3. The assembly of claim 1 wherein the first and second sockets are independently pivotably interconnected with the housing via the respective first and second supports and mounting members.

4. The assembly of claim 1 wherein the lighting element is at least one of an incandescent light, a fluorescent light, or an LED-type light.

5. A light fixture comprising:

a housing;

a socket constructed to engage a lighting element contained within the housing;

a mounting member to which the socket is secured;

a pivot connection for providing movement of the mounting member, and thereby the socket, between a first, operating position and a second, service position; and a spring that acts on the mounting member to bias the socket toward the first, operating position, wherein the housing includes a mounting bracket, and wherein the mounting member is pivotably interconnected with the mounting bracket and the spring is interposed between the mounting bracket and the mounting member, wherein the spring comprises a spring plate carried by the mounting bracket and engageable with one or more tab members associated with the mounting member.

6. The light fixture of claim 5 wherein the one or more tab members engage the spring upon pivoting movement of the mounting member to deflect the spring away from the mounting bracket.

7. A light fixture comprising:

a housing;

a socket constructed to engage a lighting element contained within the housing;

a mounting member to which the socket is secured;

a pivot connection for providing movement of the mounting member, and thereby the socket, between a first, operating position and a second, service position; and a spring that acts on the mounting member to bias the socket toward the first, operating position, wherein the housing includes a mounting bracket, and wherein the mounting member is pivotably interconnected with the mounting bracket and the spring is interposed between the mounting bracket and the mounting member, wherein the spring includes an opening therein constructed to allow a locating arm associated with the mounting member to pass therethrough and to define the range of movement of the mounting member.

8. A method of constructing a light assembly comprising the steps of:

providing a housing;

providing a first socket assembly having a first socket constructed to engage a first light element;

providing a second socket assembly having a second socket constructed to engage a second light element;

interconnecting the first and the second socket assemblies with the housing to allow rotation of the sockets relative to the housing, and wherein the first and second socket assemblies are constructed such that the first and second light elements are in linear alignment with one another when the socket assemblies are in an operative first position, and wherein the first and second socket assemblies are rotatable to a second service position in which the socket assemblies are moved out of alignment with each other to facilitate removal and replacement of the light elements; and automatically returning the socket assemblies to the operative first position when a force holding the socket assemblies in the second service position is removed from the socket assemblies.

9. A light fixture comprising:

a housing;

a first socket assembly pivotally mounted relative to said housing, and movable between a first, operating position and a second, service position to facilitate removal of a lighting element engaged in said first socket assembly;

a second socket assembly pivotally mounted relative to said housing, and movable between a first, operating position and a second, service position to facilitate removal of a lighting element engaged in said second socket assembly, wherein the lighting elements engaged in the first and second socket assemblies are aligned with one another along a generally linear axis when the first and second socket assemblies are in the first operating position; and a first biasing mechanism associated with the first socket assembly and a second biasing mechanism associated with the second socket assembly and wherein each biasing mechanism automatically returns a respective socket assembly to the first, operating position when a force holding the respective socket assemblies in the second, service position is removed.

* * * * *